US007640955B2

(12) United States Patent
Tischer

(10) Patent No.: US 7,640,955 B2
(45) Date of Patent: Jan. 5, 2010

(54) APPARATUS FOR SPLITTING WOOD

(75) Inventor: Arthur Daniel Tischer, Calgary (CA)

(73) Assignee: Adatt Enterprises Ltd., Calgary (CA)

( * ) Notice: Subject to any disclaimer, the term of this patent is extended or adjusted under 35 U.S.C. 154(b) by 155 days.

(21) Appl. No.: 11/881,844

(22) Filed: Jul. 30, 2007

(65) Prior Publication Data

US 2008/0277023 A1 Nov. 13, 2008

(30) Foreign Application Priority Data

May 11, 2007 (CA) ..... 2588360

(51) Int. Cl.
*B27L 7/06* (2006.01)

(52) U.S. Cl. ..... 144/193.2; 144/195.8

(58) Field of Classification Search ..... 144/193.2, 144/195.1, 195.5, 195.6, 195.7, 195.8; 254/104
See application file for complete search history.

(56) References Cited

U.S. PATENT DOCUMENTS 1,283,195 A 10/1918 Hunter
4,102,373 A 7/1978 Winiasz
4,258,764 A * 3/1981 Gerst ..... 144/193.1
4,274,458 A * 6/1981 Dueweke et al. ..... 144/195.7
4,354,537 A * 10/1982 Balkus ..... 144/195.5
4,951,726 A 8/1990 Sieverin
5,526,855 A 6/1996 Graham
5,535,795 A * 7/1996 Bunn ..... 144/195.4
6,092,572 A 7/2000 Green
6,453,958 B1 * 9/2002 Slavich ..... 144/195.5
7,159,627 B2 * 1/2007 St-Germain et al. ..... 144/195.5
7,228,881 B1 * 6/2007 Smith ..... 144/193.1

FOREIGN PATENT DOCUMENTS

CA 2146291 10/1996

* cited by examiner

*Primary Examiner*—Shelley Self
(74) *Attorney, Agent, or Firm*—The Farrell Law Firm, LLP

(57) ABSTRACT

An apparatus for use in splitting and cutting wood is provided, including a frame having a log support for holding a log to be split and cut, a vertically extending frame for holding a removable wedge or axe head connected to a manually operable drive means for engaging the wedge on an upper portion of a log for cutting and splitting the log.

20 Claims, 3 Drawing Sheets

APPARATUS FOR SPLITTING WOOD

PRIORITY

This application claims priority under 35 U.S.C. §119(a) to Canadian Patent Application Serial No. 2,588,360 filed on May 11, 2007, the contents of which are hereby incorporated by reference.

BACKGROUND OF THE INVENTION

1. Field of the Invention

The present invention relates to an improved apparatus for the simultaneous cutting and splitting of wood into smaller pieces through the application of constant force of a splitting wedge onto the surface of a wood piece when in use.

2. Description of the Related Art

Various log splitting devices have been devised and used for splitting logs such as conventional hand tools such as saws and axes or hand held wedges which are driven into a log in order to split the wood. Such devices, while inexpensive, require skilled manual labour, significant physical exertion and are very time intensive with regard to the use of hand tools. Other log splitting devices which have become fairly commonplace for splitting logs include large hydraulic cylinders which, generally speaking, is powered by an electric or gasoline engine and are typically aimed at commercial use, complex and expensive.

Typical of the prior art is Canadian Patent Application 2,146,291 (abandoned), which broadly teaches an automotive mechanical or manually actuated jack for use in splitting wood. As illustrated, the device includes a conventional automotive mechanical jack to which an axe head is attached. The mechanical jack, during the act of splitting the log or piece of wood, raises the base of the device and the wood to force the piece of wood into the axe head, such that the axe contacts and cuts into the center of the piece of wood to split the log.

Another reference typical of the prior art is U.S. Pat. No. 5,535,795 to Bunn, which generally teaches the use of a conventional automotive jack for use in a log splitting apparatus. Bunn generally discloses an apparatus which includes the use of any type of jack arranged such that the wedge member is attached to the jack member and when manually actuated, the jack member moves downwardly such that the wedge splits the wood from a central point of the log. The jack is manually raised or lowered by means of the jack handle or lever.

Other background references include U.S. Pat. No. 1,283,195 to Hunter, which discloses a motorized log splitting device, which includes a wedge which is forced into the center of a log to be split. U.S. Pat. No. 111,333 to Fitch discloses a log splitter, mounted in a horizontal orientation, to impart a force to the piece of wood to be split, including wood retaining means. U.S. Pat. No. 6,092,572 to Green, which discloses a vertically oriented wood splitter using a manually operated hydraulic jack, where the jack is raised using a lever or handle member to raise the piece of wood to force the wood into the axe head.

Other references include U.S. Pat. No. 5,526,855 to Graham; U.S. Pat. No. 4,951,726 to Sieverin and U.S. Pat. No. 4,102,373 to Winiasz; all of which disclose powered horizontal and vertical splitters, which force the head of an axe or other wedge shaped device into the center of the log to be split.

Despite past attempts in this field, there remains a need for a simple, portable, cost efficient log splitter which is sufficiently powerful to cut or split pieces of wood or logs, and yet is simple and lightweight in construction. Preferably, such an improved wood splitting device has the ability to be easily and quickly dismantled for easy transportation and set up, simple to use and also to place in storage when not in use, for example home use or camping.

SUMMARY OF THE INVENTION

In accordance with a preferred embodiment of the present invention there is provided a portable log splitter comprising an inner non-moveable elongated hollow rigid frame member, an outer hollow elongated moveable rigid frame member having a pair of opposed ends and at least partially surrounding said inner frame member, said outer frame member being axially along said inner frame member, wood splitting means secured to said outer frame member at a point spaced from the opposed ends thereof, and drive means mounted for axial movement positioned and fixedly secured within said inner frame member, said drive means being fixedly secured to said outer rigid frame for effecting axial movement of said outer frame member relative to said inner frame member whereby movement of said wood splitting means is effected to permit said wood splitting means to engage at least the outer circumference of a log to be split when a log is placed between a substrate and said wood splitting means.

Desirably, the log splitter includes a base adapted to releasably engage the inner elongated frame member.

Preferably, the inner hollow frame member further includes detent means for operative engagement with the drive means.

In accordance with any of the above aspects, the outer frame member includes releasable mounting means proximate one of the opposed ends for receiving and releasably securing the wood splitting means.

In accordance with a further preferred embodiment, the drive means may include manual actuation means, mechanical drive means or drive means which is powered. Preferably, the manual actuation means includes a handle which is operatively connected to the drive means.

In accordance with any of the above aspects, the splitting means is preferably a splitting wedge or an axe head.

In accordance with the above preferred embodiment, the drive means includes an elongated screw member having opposed ends, a mounting plate in operative association with the detent means of the inner rigid frame member at least one corresponding nut member and attached to the elongated screw member.

Desirably, the same further includes an assembly cap for mounting on one of the opposed ends of the outer rigid frame to secure the drive means and the outer rigid frame to the inner rigid frame at one end thereof.

In accordance with the above aspect, the log splitter may further include a handle operatively associated with the drive means that when actuated, effects rotation of the elongated screw member to effect movement of the outer rigid frame member relative to the inner rigid frame member.

In accordance with any of the above noted aspects, the rigid frame members are preferably hollow steel tube members. Desirably, the inner and outer rigid frame members include at least one aperture adapted to receive corresponding locking means.

A preferred alternative embodiment, the log splitter includes attachment means for attachment to a vehicle, for example attachment means with corresponds to a vehicle hitch or other similar device.

In a further preferred alternative embodiment, the portable log splitter may further include attachment means for attaching the log splitter to a vertical surface of a structure, such as a wall.

In accordance with any of the above aspects, the log splitter is preferably in the form of a kit which is easily assembled and disassembled.

These and other aspects and features of the preferred embodiment of the present invention are illustrated in the accompanying drawing figures in which:

DETAILED DESCRIPTION OF THE PREFERRED EMBODIMENTS

Figure 1:
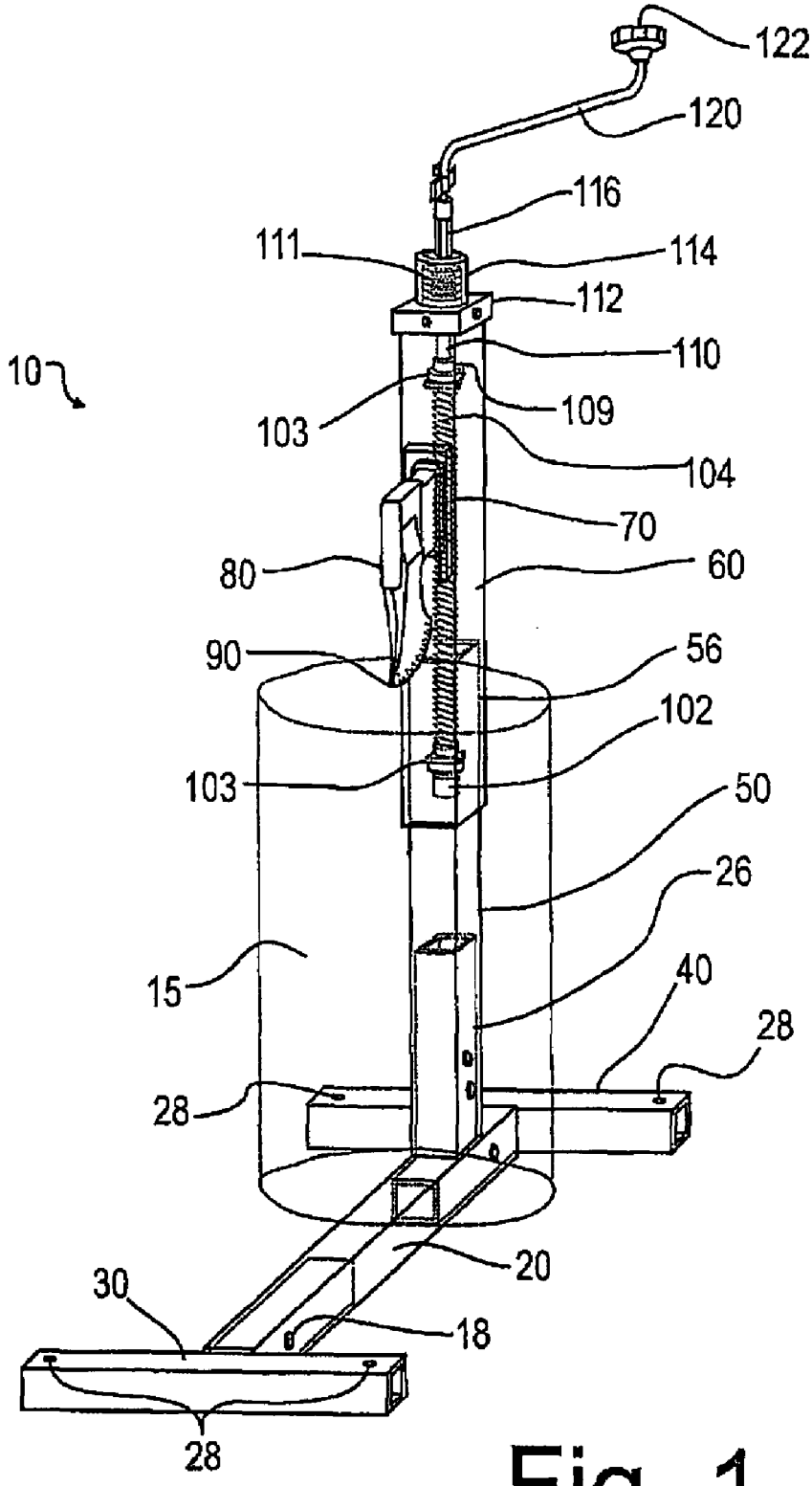
FIG. 1 is a perspective of the log splitting apparatus in accordance with a preferred embodiment of the present invention.

As illustrated in the accompanying drawing Figures, there is provided an improved log splitting device generally identified by reference numeral 10. Like components or features are designated by like reference numerals, through the various figures as described in greater-detail hereinbelow.

As illustrated in FIG. 1, the log splitting apparatus 10 includes a horizontally oriented supporting base including a primary frame or support member 20 having opposed ends 22 and 24. Support for member 20, in use, acts as a log support upon which a piece of wood or log is positioned for cutting and splitting. As illustrated, support member 20 includes a vertically oriented projection or extension 26 adapted to receive a further frame member, the vertically oriented projection 26 being located proximate one end of the member and slightly spaced therefrom. As shown, member 26 is at a generally right angle to the surface of the support member 20.

In a preferred embodiment, member 26 includes at least one aperture or other similar means to releasably secure the further frame member thereto, such that the further member may be raised or lowered in order to adjust the height of the other frame member.

The opposed ends of the support member 20 are adapted to receive a pair of horizontally oriented end members 30 and 40, which as illustrated, are of a generally T-shaped configuration and are adapted to be removably attached to opposed ends 22 and 24. End member 30 and 40 include a projection or extending member (32 and 42, respectively) for insertion into support member 20.

As illustrated in FIG. 1, the supporting base is adapted to provide a stable support upon which the weight of a log or piece of wood to be cut rests and is cut and/or split thereupon. As shown, member 20 is in an "in use" orientation, or horizontally disposed, with the end members 30 and 40 extending providing a stable base with the projection or extension 26 extending generally vertically from the frame member. In a preferred embodiment, the frame members are tubular members, and may be of a suitable material, such as metal, steel, alloys, plastic, etc., or other suitable material known in the art.

Figure 2:
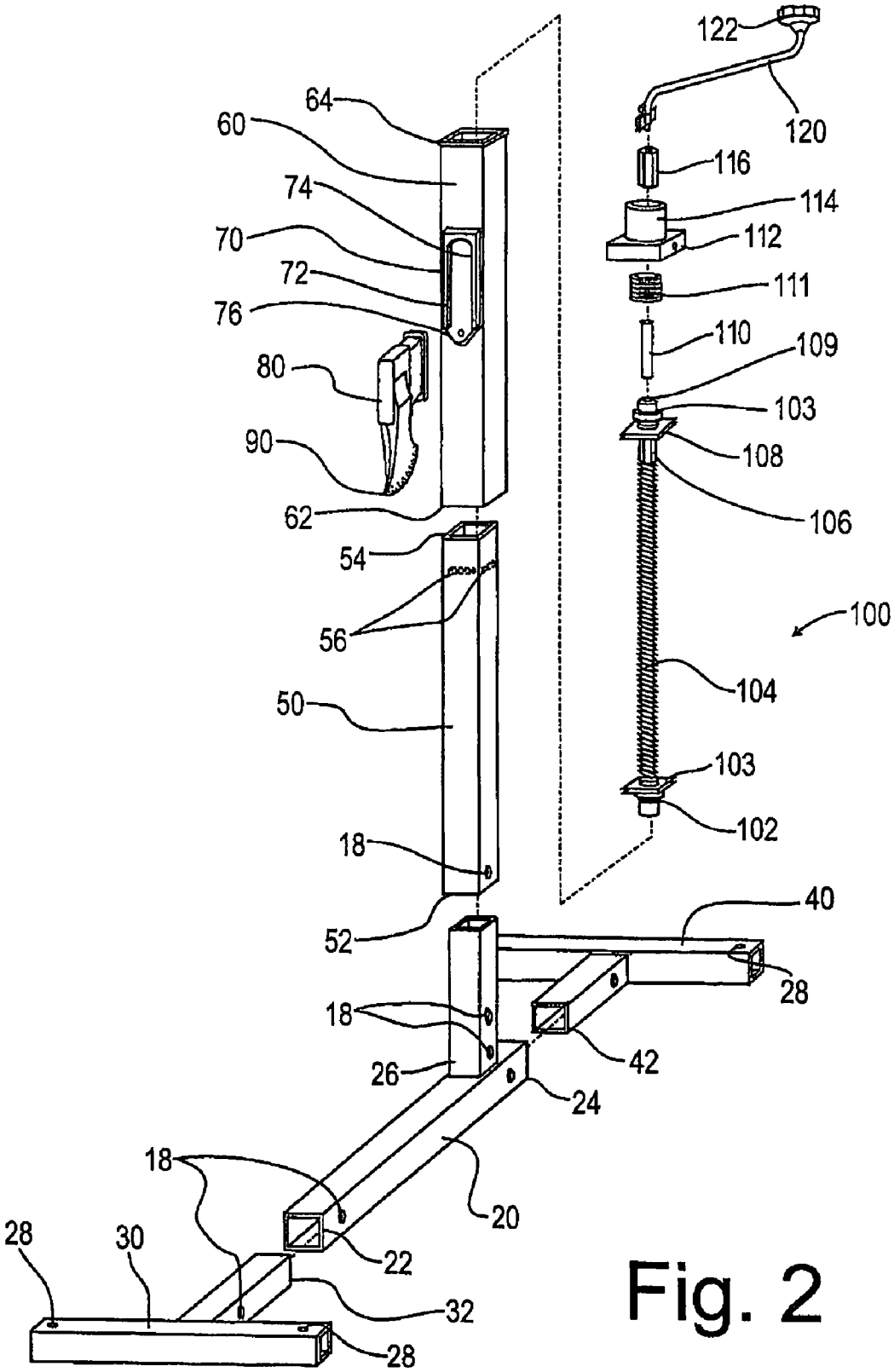
FIG. 2 is a schematic view of the elements of the log splitting apparatus of FIG. 1.
Figure 3:
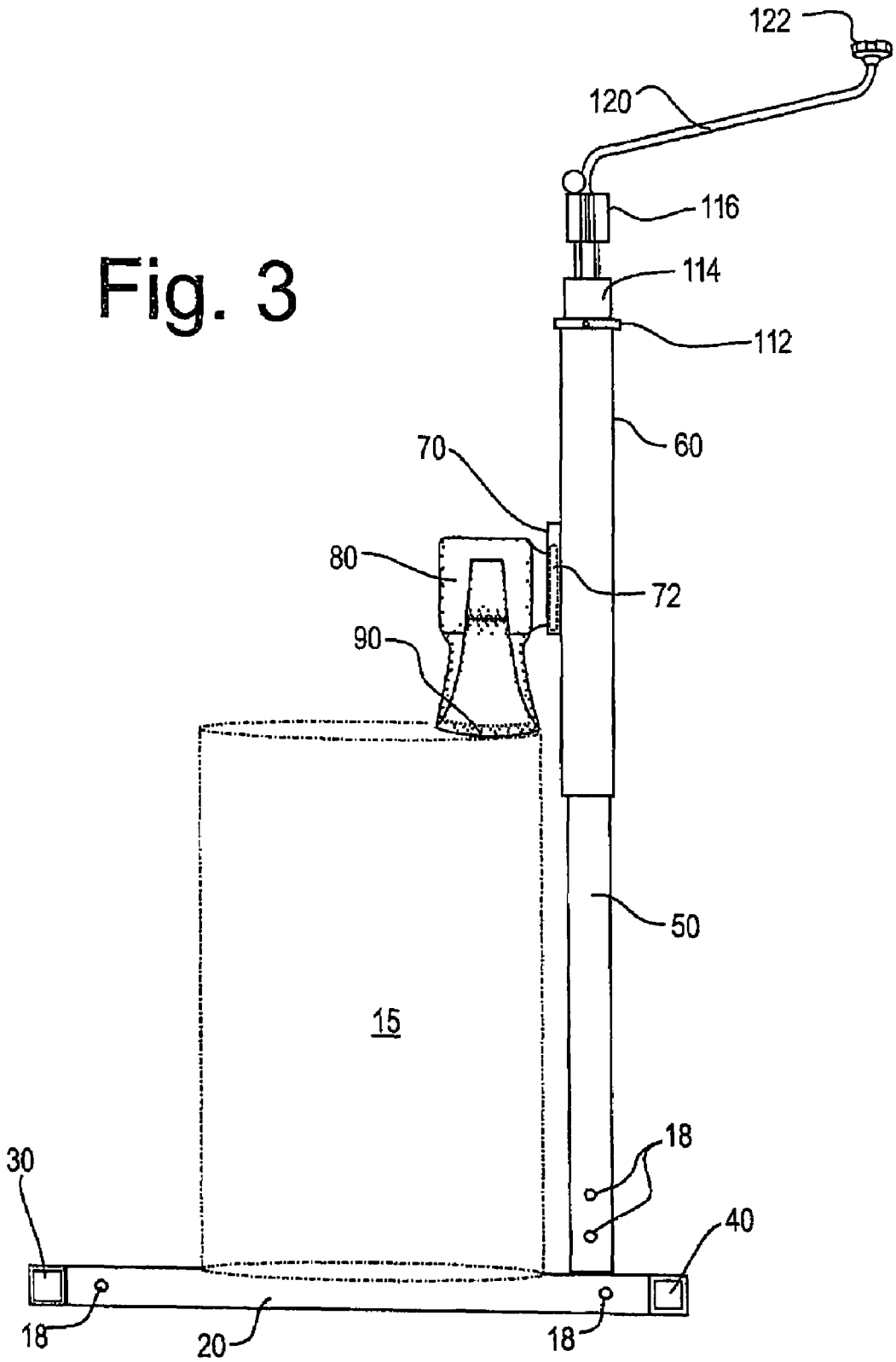
FIG. 3 is a side view of the log splitting apparatus of FIG. 1.

As illustrated in the drawing figures, and in particular FIGS. 1 and 2, the base or frame members include suitable apertures or other means to releasably engage with the corresponding or mating frame members such that the log splitter is able to be quickly assembled and disassembled for storage or transportation. As illustrated, base or frame members 20, 26, 30 and 40 include apertures 18 through which pins or other locking means can be inserted to releasably secure the assembly for use. As illustrated, the end members 30 and 40 may also include apertures 28 adapted to receive nails, stakes or other suitable means to secure the base of the apparatus into the ground, such as when camping, to increase the stability of the apparatus.

In a preferred embodiment, vertically extending projection 26 is adapted to receive a first supporting member or inner tubular portion 50. Supporting member 50 is releasably connected to extension 26 to support thereon a secondary supporting member, discussed in greater detail below. As illustrated, the inner tubular member 50 includes opposed ends 52 and 54, where open end 52 is adapted to be placed over the projection 26 and secured thereto, such as through the use of suitable pins 18 or other locking means. Locking means or pins 18 permit member 50 to be raised or lowered in relation to member 26, in order to accommodate larger or smaller sized logs or pieces of wood to be cut or split.

Opposite end 54 is adapted to receive the mechanical drive means, discussed in greater detail below. In a preferred embodiment, the inner tubular portion 50 includes proximate end 54 detent means, such as indentations 56, about the periphery, best seen in FIG. 2. Indentations 56 cooperate with the mechanical drive means, discussed below.

The apparatus 10 includes an outer or secondary supporting member 60, located in operative relationship with the tubular member 50. The outer tubular member 60 is adapted to be placed over the inner tubular member 50. As illustrated in the Figures, and more particularly FIG. 2, member 60 includes opposed ends 62 and 64. End 62 is adapted to matingly correspond with member 50 and when assembled, slides over end 54 into an operative position thereon. End 64 is adapted to receive an assembly cap 112 which helps secure and house the brake nut assembly 111.

Mounting means 70 is provided to releasably secure the splitting wedge or axe head 80. As illustrated, mounting means 70 includes mounting plate 72 attached or otherwise secured to the outer tubular member 60. The plate 72 preferably includes a groove or track 74 which releasably engages with the splitting wedge 80. This allows for easy removal of the wedge 80 for sharpening or replacement.

Preferably, the mounting plate 72 further includes a spring button 76 to allow the wedge or axe head 80 to be easily removed or installed. The axe head 80 may be of a common shape (i.e., wedge shaped) and is adapted to slide into the track of the mounting bracket. The blade portion 90, when in use, is adapted to cut into the piece of wood 15 to effect splitting of the wood.

In a preferred embodiment, a mechanical drive means generally referred to by reference numeral 100 is adapted to tubular member 50 which is secured therein via detent means or indentations 56. As illustrated, the preferred embodiment of the mechanical drive means 100 includes at one end thereof a ball screw end stop 102, suitable torque absorber 103 and a screw rod 104 to which is attached at the opposite end thereof a ball screw nut or other similar means 106 and a screw or ball screw mounting plate 108 and a suitable torque absorber 103, and a shaft collar 109. As illustrated, the ball screw plate rests against indentations 56.

Outer or secondary tubular member 60 is adapted for placement over inner tube 50, all of which is secured via assembly cap 112 through member 109 to the mechanical drive means inside tubular member 50. Assembly cap 112 includes an upper portion 114 including an aperture which is adapted to house a backnut brake assembly 111 and to receive a further assembly 116 which is adapted to receive a crank arm 120 including handle 122 for manual actuation of the mechanical drive means to raise and lower the outer tubular portion 60 to effect the cutting and splitting of a piece of wood or log 15. Mechanical drive means 100, when in use exerts constant pressure or force via the wedge 80 on to the piece of wood or log 15. Member 116, in a preferred embodiment, is preferably a male hex or other similar means which is an operative relationship with the drive screw of the mechanical drive.

As such, the mechanical drive is adapted that it can be manually raised or lower by means of a removable/swivel type handle such as the crank arm 120 and handle 122 as illustrated in FIG. 2. Alternatively, the drive may also be actuated through the use of a ratchet and socket, adjustable wrench, or open ended wrench. Further, a drive bit may be used in combination with an electric motor such as attached to a drill or other means to effect the raising and lowering of the wedge into the piece of wood.

In operation and use, the apparatus 10 is positioned on the ground or other generally horizontal surface with the base members 20, 30 and 40 supporting the generally vertically extending members 50 and 60. A log or other piece of wood 15 is then placed immediately below the wedge 80 on top of horizontally extending member 20 and maintained in such a position while a user, either manually or otherwise, lowers the axe head to engage the blade portion 90 to the upper surface of the log 15. As illustrated, the blade 90 contacts the piece of wood or log 15 at the edge of the log. In particular, the wedge via blade 90 engages the outer circumference of the log to be split when the log is placed between the frame 20 and the wedge 80.

In operation, a user then may actuate the mechanical drive means to effect lowering of the outer tubular member 60 about the lower or inner member 50 to cut and split the piece of wood via wedge 80 to begin splitting and cutting of the log 15. As the user manually or otherwise actuates or effects movement of the drive, this causes the splitting wedge or axe to apply a constant force to cause the piece of wood 15 to split. The user continues this action until the wedge splits the log 15. Advantageously, it has been found that the use of the tubular frame 20 assists in localizing the force exerted by the wedge 80 to the log 15 thus assisting in a more efficient split and cut of the piece of wood or log 15. As noted hereinabove, the constant pressure exerted by the mechanical drive means via the wedge 80 to the piece of wood 15 applies a constant force engaging at least a portion of the outer circumference of the log to effect a more efficient splitting and cutting of the wood.

The height of the first tubular member 50 may be raised or lowered via locking means (for example pins 18) releasably inserted in to apertures 18 to accommodate different sizes or pieces of wood to be cut. This allows the height of the member 50 to be quickly and securely adjusted to different sizes of logs or wood. Through the continued manual actuation of the mechanical drive means results in the wedge completely splitting the log or piece of wood. The split portions of the piece of wood or log 15 typically fall to either side of the generally horizontal member 20 after which the wedge can be manually or otherwise mechanically raised to accommodate a new log to allow the user to repeat the process to cut and split additional pieces of wood.

In an alternative embodiment, the user operated handle may be replaced with motorized means to effect the raising and lowering of the wedge. This may be powered through a motor, drill or other suitable drive means.

The base 20 preferably includes means to allow the apparatus to be used free standing, or in an alternative embodiment, wall or floor mounted with the use of suitable brackets or mounting means. Alternatively, the apparatus 10 may be used in combination with a conventional hitch receiver of a vehicle.

In an alternative embodiment, the backnut brake assembly 111 may be located within an upper part of the outer member 60, for example, resting on a plate that is fastened (through suitable means such as welding) to the inside of the outer member at a desired height. Alternatively, indentations or other suitable means could be provided to hold the plate in place. In a further preferred embodiment, the end cap assembly 112 may be smaller cap, such that it could be separate from the backnut brake assembly.

In a further alternative aspect, flange bearings or similar means may be provided to assist the torque absorbers 103 to allow the ballscrew to be free turning once it bottoms or tops out. Desirably, a further flange bearing could be added to the shaft 110 to prevent the shaft collar 109 from being in constant contact with the top of the outer member, thus preventing metal-to-metal contact.

As noted above, the present invention provides advantages over the prior art and for that matter other hand tools as commonly used to split or cut wood such as an axe or splitting wedge. The present invention also provides a safer device and method for splitting wood than, for example, someone using an axe to split the wood which could potentially cause injury by users who are unskilled or inexperienced with the proper use of an axe or splitting wedge.

While one embodiment of the present invention has been described in the foregoing description, it is to be understood that other embodiments are possible within the scope of the claimed invention.

What is claimed is:

1. A portable log splitter comprising:

an inner non-moveable elongated hollow rigid frame member;

an outer hollow elongated moveable rigid frame member having a pair of opposed ends and at least partially surrounding the inner frame member, the outer frame member being axially moveable along the inner frame member;

means for wood splitting secured to the outer frame member at a point spaced from the opposed ends thereof; and means for driving mounted for axial movement positioned within the hollow inner frame member, the means for driving being fixedly secured to the outer rigid frame for effecting axial movement of the outer frame member relative to the inner frame member whereby movement of the means for wood splitting is effected to permit the means for wood splitting to engage at least the outer circumference of a log to be split when the log is placed between a substrate and the means for wood splitting.

2. The portable log splitter according to claim 1, further including a base member adapted to releasably engage the inner frame member.

3. The portable log splitter according to claim 1, wherein the inner hollow frame member further includes detent means for operative engagement with the means for driving.

4. The portable log splitter according to claim 2, wherein the inner frame member is adjustable with respect to the base member.

5. The portable log splitter according to claim 1, wherein the outer frame member includes releasable mounting means proximate one of the opposed ends for receiving and releasably securing the means for wood splitting.

6. The portable log splitter according to claim 1, further comprising means for manually actuating the means for driving includes manual actuation.

7. The portable log splitter according to claim 1, wherein the means for driving is mechanical.

8. The portable log splitter according to claim 1, wherein the means for driving is a powered means for driving.

9. The portable log splitter according to claim 6, wherein the means for manually actuating includes a handle operatively connected to the means for driving in a rotational manner.

10. The portable log splitter according to claim 1, wherein the means for wood splitting is a splitting wedge.

11. The portable log splitter according to claim 1, wherein the means for wood splitting is an axe head.

12. The portable log splitter according to claim 3, wherein the means for driving includes an elongated screw member having opposed ends, a mounting plate in operative association with the detent means of the inner frame member and at least one corresponding nut member attached to the elongated screw member.

13. The portable log splitter according to claim 12, further including an assembly cap for mounting on one of the opposed ends of the outer frame member to secure the means for driving and the outer frame member to the inner frame member at one end thereof.

14. The portable log splitter according to claim 13, further including a handle operatively associated with the means for driving that when actuated, effects rotation of the elongated screw member to effect movement of the outer frame member relative to the inner frame member.

15. The portable log splitter according to claim 1, wherein the inner and outer frame members are hollow tubular metal members.

16. The portable log splitter according to claim 1, wherein the inner and outer frame members include at least one aperture adapted to receive corresponding means for locking.

17. The portable log splitter according to claim 10, further comprising attachment means for attachment to a vehicle which creates a point of stability during use.

18. The portable log splitter according to claim 17, wherein the attachment means corresponds to a vehicle hitch which creates a point of stability during use.

19. The portable log splitter according to claim 10, further including attachment means for attachment of the log splitter to a vertical surface of a structure.

20. The portable log splitter according to claim 19, wherein the vertical surface is a wall.

* * * * *